US011142725B2

(12) United States Patent
Al-Bayati et al.

(10) Patent No.: US 11,142,725 B2
(45) Date of Patent: Oct. 12, 2021

(54) COMPOSITION FOR USE IN A MACHINE DISHWASHER

(71) Applicant: Reckitt Benckiser Finish B.V., Hoofddorp (NL)

(72) Inventors: Alias Younis Al-Bayati, Heidelberg (DE); Christoph Deckert, Burghausen (DE); Michael Zahner, Frankenthal (DE); Judith Preuschen, Sörgenloch (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 76 days.

(21) Appl. No.: 16/322,283

(22) PCT Filed: Aug. 14, 2017

(86) PCT No.: PCT/EP2017/070640
§ 371 (c)(1),
(2) Date: Jan. 31, 2019

(87) PCT Pub. No.: WO2018/033526
PCT Pub. Date: Feb. 22, 2018

(65) Prior Publication Data

US 2019/0185787 A1 Jun. 20, 2019

(30) Foreign Application Priority Data

Aug. 15, 2016 (GB) ..... 1613951

(51) Int. Cl.

| | |
|---|---|
| ***C11D 3/37*** | (2006.01) |
| ***C11D 3/20*** | (2006.01) |
| ***C11D 17/04*** | (2006.01) |
| ***C11D 11/00*** | (2006.01) |
| ***C11D 3/39*** | (2006.01) |

(52) U.S. Cl.
CPC ..... *C11D 3/3753* (2013.01); *C11D 3/2041* (2013.01); *C11D 3/2065* (2013.01); *C11D 3/3719* (2013.01); *C11D 3/3723* (2013.01); *C11D 3/3757* (2013.01); *C11D 3/3905* (2013.01); *C11D 11/0023* (2013.01); *C11D 17/041* (2013.01); *C11D 17/042* (2013.01)

(58) Field of Classification Search
None
See application file for complete search history.

(56) References Cited

U.S. PATENT DOCUMENTS

| | | | | |
|---|---|---|---|---|
| 5,798,152 | A * | 8/1998 | Stevens | B32B 27/08 264/514 |
| 8,728,449 | B2 * | 5/2014 | Verrall | C11D 17/043 424/70.11 |
| 2002/0169092 | A1 * | 11/2002 | Alexandre Catlin | B65B 47/10 510/220 |
| 2006/0118141 | A1 | 6/2006 | Andriola et al. | |
| 2006/0258553 | A1 | 11/2006 | Catalfamo et al. | |
| 2008/0146481 | A1 | 6/2008 | Brown et al. | |
| 2008/0182937 | A1 * | 7/2008 | Urian | C08K 5/103 525/57 |
| 2009/0004234 | A1 | 1/2009 | Kessler et al. | |
| 2012/0302489 | A1 | 11/2012 | Rodrigues et al. | |
| 2015/0297494 | A1 | 10/2015 | Mao et al. | |
| 2016/0008235 | A1 | 1/2016 | Sivik et al. | |
| 2016/0102278 | A1 | 4/2016 | Labeque et al. | |

FOREIGN PATENT DOCUMENTS

| | | | |
|---|---|---|---|
| GB | 2090603 | A | 7/1982 |
| WO | 2016023685 | A1 | 2/2016 |

OTHER PUBLICATIONS

International Search Report and Written Opinion issued in international application No. PCT/EP2017/070640 dated Nov. 3, 2017.
European Examination and Search Report issued in British application No. GB1613951.1 dated Mar. 9, 2017.
International Preliminary Report on Patentability for PCT/EP2017/070640 dated Feb. 19, 2019.

* cited by examiner

*Primary Examiner* — Katie L. Hammer
(74) *Attorney, Agent, or Firm* — Troutman Pepper Hamilton Sanders LLP; Ryan Schneider; Chris N. Davis

(57) ABSTRACT

A composition comprising: from 25 to 80 wt % of at least one vinyl acetate-vinyl alcohol copolymer, where the copolymer comprises at least 85 mol % vinyl alcohol units; from 1 to 25 wt % of at least one polyhydric alcohol; and from 5 to 50 wt % of a first active agent which is: a polymer comprising a monomer having at least one carboxylic acid group or a salt or ester thereof; a polymer comprising a monomer having at least one imine group or a salt thereof; or a polymer comprising a monomer having at least one aspartic acid group or a salt or ester thereof. A package containing the composition. A method of preparing the composition, the method comprising extruding the composition. A method of machine dishwashing, wherein the first active agent is released into wash water over the course of a plurality of dishwashing programs.

16 Claims, No Drawings

COMPOSITION FOR USE IN A MACHINE DISHWASHER

TECHNICAL FIELD

The present invention relates to a composition for use in a machine dishwasher. In particular, the invention relates to a composition which can gradually dissolve and/or disperse over a plurality of wash programs in a machine dishwasher. The composition allows for controlled release of a specified polymeric active agent over the plurality of wash programs.

BACKGROUND

Different types of automatic dishwashing machines exist, which tend to be designed very differently for the domestic market versus the commercial/institutional markets. Generally the differences are in terms of size and volume of throughput. Industrial/institutional machines often have much shorter but more energy intensive (e.g. higher temperature) cycles compared to domestic machines, and/or use much more aggressive chemistry (e.g. very highly alkaline detergent). In the interests of speed, they may not use a drying stage at the end of the cycle. For instance, the industrial program cycles can be as short as 5 minutes or less, whereas programs in domestic machines can be 30 minutes to 3 hours or more. The non-domestic machines can be based on a conveyor system in which dishware is moved through a single or multiple tanks of the dishwasher, whereas in domestic machines the dishware will generally always remain stationary in one tank inside the dishwasher, and all the washing steps will occur in that single tank. The conventional household dishwasher design also involves one or more rotating spray arms positioned inside the machine, whereas non-domestic machines may use fixed spray systems; the water consumption may be very different. The main focus of the present invention is on the domestic automatic dishwashing sector.

It is known to use detergent compositions in automatic dishwashing applications, which typically include active cleaning agents like builders and bleach to remove soils from tableware during a main wash cycle. Various dishwashing "additives" are also known in the art, which are separate compositions used in addition to the main detergent composition. For example, a "rinse aid" may be used in a subsequent rinse cycle to remove excess water from the tableware, to ensure that the tableware dries as quickly and efficiently as possible and provide an anti-spotting/anti-filming function. Traditionally, a rinse aid will include a non-ionic surfactant and may further include a polymer exhibiting additional rinse aid performance. Some such ingredients may also be included in main wash detergent compositions that are released during the main wash cycle but "carry over" to the rinse cycle.

Compositions for automatic dishwashing applications are conventionally provided in the form of powders, granules, tablets, liquids or gels. Today's domestic machines generally have a dispenser in the door into which the consumer adds the main wash detergent. When flowable, the domestic consumer may pour the main wash detergent into the dispenser. This can lead to problems; accidental under-dosing leads to an imperfect wash result, whereas over-dosing means wasted cost and unnecessary environmental impact. Alternatively, compositions may be provided inside a unit dose format such as a pouch, holding a pre-measured quantity of the composition. For example, a composition may be enveloped in a water-soluble or water-dispersible package, to be released as the package dissolves or disperses during use. Irrespective of the physical form the composition takes, the user is instructed to replenish the main wash detergent for each full program cycle, which is time-consuming and inconvenient.

On the other hand, when a separate rinse aid additive is used as well as the main wash detergent, the consumer periodically adds this to a separate dispenser in the machine, which acts as a reservoir and automatically mechanically dispenses a pre-set quantity into the machine each rinse cycle (e.g. using a pump). This separate dispenser is only designed to receive a rinse aid in liquid form, and is limited in volume, so this limits the ingredients that can be used, and there is no flexibility to use additives in other product formats or a greater quantity of additive which could last for a greater number of cycles.

US 2015/0297494 discloses a filament comprising one or one or more low hydrolysis vinyl acetate-vinyl alcohol copolymers (i.e. partially hydrolysed polyvinylalcohol) and one or more active agents present within the filament. The copolymer comprises 84 mol % or less alcohol units. Such filaments would rapidly dissolve under the conditions found during a full dishwasher wash program and, like the composition forms discussed above, would generally only survive a single program.

There is a need for a composition that allows for automatic controlled release of an appropriate quantity of an active agent over a plurality of wash programs in a machine dishwasher, particularly a domestic dishwasher, obviating the need for the user to add the composition to a dispenser at the start of every program. Ideally, the active agent is at least as effective at performing its intended function as when it is used in conventional single cycle compositions. Advantageously the composition can be supplied from a location other than the dispenser of the dishwasher and/or is in a consolidated, non-tablet form (which does not need to be enclosed within a water soluble or water dispersible package to supply it to the dishwasher).

Moreover, there are compositions on the market, such as machine cleaning compositions, which perform a maintenance function (e.g. removal of built up grease and limescale) and are intended for use only after a certain number of wash programs have been carried out. Accordingly, it would be desirable to provide a composition that could serve as an indicator, alerting the user as to when a particular composition (e.g. a machine cleaner) should be added and/or a particular maintenance task needs to be performed.

SUMMARY OF THE INVENTION

According to a first aspect, the present invention provides a composition for use as a machine dishwashing detergent or additive comprising: from 25 to 80 wt % of a vinyl acetate-vinyl alcohol copolymer, where the vinyl acetate-vinyl alcohol copolymer comprises at least 85 mol % vinyl alcohol units; from 1 to 25 wt % of a polyhydric alcohol; and from 5 to 50 wt % of a first active agent comprising a polymer comprising a monomer selected from the group consisting of a monomer (i) having at least one carboxylic acid group or a salt or ester thereof, (ii) having at least one imine group or a salt thereof, and (iii) having at least one aspartic acid group or a salt or ester thereof.

According to a second aspect, there is provided a package comprising the composition according to the invention in its first aspect.

According to a third aspect, there is provided a method of preparing a composition according to the invention in its first aspect, comprising extruding the vinyl acetate-vinyl alcohol copolymer, the polyhydric alcohol and the first active agent.

According to a fourth aspect, there is provided a method of machine dishwashing, using the composition according to the invention in its first aspect or the package according to the invention in its second aspect, wherein the first active agent is released into wash water over a the course of a plurality of dishwashing programs.

According to a fifth aspect, there is provided the use of the composition according to the invention in its first aspect, or the package according to the invention in its second aspect, in a plurality of wash programs in a machine dishwasher to signal that a maintenance task should be performed once the composition has fully dissolved or dispersed at the end of the plurality of wash programs.

DETAILED DESCRIPTION

The composition of the invention does not rapidly dissolve during a first wash program, but instead is able to gradually dissolve and/or disperse over a plurality of wash programs in a machine dishwasher, preferably a domestic dishwasher. Advantageously, the composition is eventually able to fully dissolve and/or disperse, leaving no residue left behind after the lifetime of the product that the user must dispose of separately. The first active agent is also released in a controlled manner as the composition gradually dissolves or disperses. Surprisingly, the first active agent is generally at least as effective at performing its intended function (e.g. rinse aid) as when it is used in conventional single cycle compositions.

It will be appreciated that as well as being suitable for use in a machine dishwasher, the compositions disclosed herein may also be capable of use in other applications in which slow dissolution when in contact with water is desirable, such as other cleaning operations.

The present invention will now be described further. In the following passages different aspects/embodiments of the invention are defined in more detail. Each aspect/embodiment so defined may be combined with any other aspect/embodiment or aspects/embodiments unless implicitly inconsistent or clearly indicated to the contrary. In particular, any feature indicated as being preferred or advantageous may be combined with any other feature or features indicated as being preferred or advantageous.

Amounts given in wt % herein refer to the % by weight of the whole composition.

Vinyl Acetate-Vinyl Alcohol Copolymer

The composition comprises from 25 to 80 wt %, such as 26 to 75 wt %, from 27 to 70 wt %, or most preferably from 30 to 60 wt %, of at least one vinyl acetate-vinyl alcohol copolymer, where the at least one vinyl acetate-vinyl alcohol copolymer comprises the at least 85 mol % vinyl alcohol units. Such copolymers are known in the art and are typically prepared by polymerizing vinyl acetate monomer followed by hydrolysis of some of the acetate groups to alcohol groups, rather than polymerizing vinyl acetate and vinyl alcohol monomer units. The term "copolymer" in this context is intended to convey that the substance comprises both acetate and alcohol groups, i.e. is not a 100% hydrolyzed polyvinylalcohol. By varying the hydrolysis reaction conditions, such as catalyst concentration, reaction temperature and reaction time, the content of residual acetyl groups (i.e. unhydrolyzed acetyl groups) can be adjusted routinely. Since a relatively high proportion of vinyl acetate units in the present invention have been hydrolysed to vinyl alcohol, the copolymers disclosed herein may be classed as "high hydrolysis" polyvinylalcohols (vinyl acetate-vinyl alcohol copolymers). It will be understood that these copolymers differ from the "low hydrolysis" vinyl acetate-vinyl alcohol copolymers known from US 2015/0297494, which comprise at most 84 mol % vinyl alcohol units and typically less.

In the present invention, the vinyl acetate-vinyl alcohol copolymer may be a polyvinylalcohol copolymer, i.e. a polymer comprising vinyl acetate and vinyl alcohol monomer units along with at least one other monomer unit, or it may be a polyvinylalcohol derivative, such as an end-capped polyvinylalcohol. Preferably, however, it is a polyvinylalcohol, i.e. a polymer comprising vinyl acetate and vinyl alcohol monomer units with no other monomer unit.

Preferably, the degree of hydrolysis of the vinyl acetate-vinyl alcohol copolymer is at least 86, 87, 88, 89, 90, 91, 92, 93, 94, 95, 96, 97, or 98 mol %, and/or no more than 99.5, 99.4, 99.3, 99.2, 99.1, 99.0, 98.9, or 98.8 mol %. In general, the higher the degree of hydrolysis, the slower the dissolution rate, but it is desired that the composition is not completely insoluble. Thus, the selection of a specific degree of hydrolysis of the vinyl acetate-vinyl alcohol copolymer allows the dissolution rate to be tuned to suit a given application.

Preferably, the at least one vinyl acetate-vinyl alcohol copolymer has an average molecular weight of: at least 1000 g/mol, preferably at least 2000, 5000, 10,000, 15,000, 20,000, 25,000, 30,000, 35,000, 40,000, or 45,000 g/mol; and/or no more than 90,000 g/mol, preferably no more than 85,000, 80,000, 75,000, 70,000, 65,000, 60,000, 55,000, or 50,000 g/mol.

In an embodiment, the viscosity of a 4% aqueous solution of the copolymer at 20° C. is at least 2, 3, 4, 5, 6, 7 or 8 mPa·s and/or no more than 15, 14, 13, 12, 11, 10 or 9 mPa·s.

Suitable vinyl acetate-vinyl alcohol copolymers for use in the present invention include appropriate hydrolysis grades in the Mowiol® range, commercially available from Kuraray.

The composition may include a mixture of vinyl acetate-vinyl alcohol copolymers comprising at least 85 mol % vinyl alcohol units. Preferably, the at least one vinyl acetate-vinyl alcohol copolymer is present in a total amount of at least 20, 25, 30, or 35 wt % and/or no more than 80, 75, 70, 65, 60 or 55 wt %. In other words, if the composition comprises a plurality of these copolymers, the sum total of their concentrations is preferably 20 to 80 wt %, whereas if there is only one of these copolymers, it may be present in an amount within this range.

Preferably, the total amount of vinyl acetate-vinyl alcohol copolymers having a degree of hydrolysis of 84 mol % or less in the composition is less than 10 wt %, preferably less than 9, 8, 7, 6, 5, 4, 3, 2, or 1 wt %. Preferably, the composition does not contain any vinyl acetate-vinyl alcohol copolymers having a degree of hydrolysis of 84 mol % or less.

Polyvinyl Acetate

Preferably, the composition further comprises polyvinyl acetate, more preferably in an amount of: at least 1 wt %, preferably at least 2, 3, 4, 5, 6, 7, 8, 9, 10, 11, 12, 13, 14, or 15 wt %; and/or no more than 30 wt %, preferably no more than 25, 20, 19, 18, 17, or 16 wt %. It has been found that the inclusion of polyvinyl acetate allows for better processing during extrusion.

Polyhydric Alcohol

The composition comprises from 1 to 25 wt %, preferably from 1 to 20 wt %, of at least one polyhydric alcohol, i.e. an alcohol containing two or more hydroxyl groups. This is a different ingredient from the vinyl acetate-vinyl alcohol copolymer. The polyhydric alcohol can act as a plasticiser, helping to ensure that the components of the composition are fully mixed during manufacture and providing a homogeneous composition.

Preferably, the polyhydric alcohol is selected from the group consisting of: an alkylene glycol, preferably having 10 C, 5 C, 4 C, or 3 C atoms or less, preferably ethylene glycol or propylene glycol; a dialkylene glycol, preferably diethyleneglycol or 1,2-dipropyleneglycol; a polyalkyleneglycol, preferably a polyethyleneglycol; a triol, preferably having 10 C, 9 C, 8 C, 7 C, 6 C, or 5 C atoms or less, such as trimethylolpropane; and a compound of the formula $HOCH_2(CHOH)_nCH_2OH$ wherein n is 1-10, preferably 1-8, 1-7, 1-6, 1-5, 1-4, 1-3, 1-2, or 1 (i.e. glycerol). When the polyhydric alcohol is a polyethyleneglycol (PEG), preferably it has a molecular weight of 1500 g/mol or less, preferably 1400, 1300, 1200, 1100, 1000, 900, 800, 700, or 600 g/mol or less, and/or a molecular weight of at least 100, 200, 300 or 400 g/mol.

It has been found that such polyhydric alcohols give good homogeneity and contribute to a slow dissolution rate of the composition, without leading to over-swelling or bursting. Most preferably, the polyhydric alcohol is glycerol. Glycerol has been found to give excellent homogeneity as well as providing a composition that is less brittle than when other polyhydric alcohols are used.

In an embodiment, the polyhydric alcohol is present in the composition in an amount of at least 2 wt %, preferably at least 3, 4, 5, 6, 7, 8, 9, or 10 wt %. Preferably, it is present in an amount of no more than 20 wt %, preferably no more than 19, 18, 17, 16, or 15 wt %. More than one polyhydric alcohol may be included in the composition; in an embodiment, the total amount of polyhydric alcohols is in the range of 5-20 wt %, such as 5 to 15 wt % or even 10 to 20 wt %.

First Active Agent

The composition of the present invention comprises from 5 to 50 wt % of a first active agent. An "active agent" may, for example, be an ingredient which improves the cleaning of tableware in a machine dishwasher, or an ingredient which improves the rinse performance. Regardless of whether the vinyl acetate-vinyl alcohol copolymer and/or polyhydric alcohol themselves offer any cleaning benefits, in the present invention the first active agent is an additional, different ingredient from these two. It is selected from the group consisting of: a polymer comprising a monomer having at least one carboxylic acid group or a salt or ester thereof; a polymer comprising a monomer having at least one imine group or a salt thereof; or a polymer comprising a monomer having at least one aspartic acid group or a salt or ester thereof.

Preferably, where the first active agent is a polymer comprising a monomer having at least one carboxylic acid group or a salt or ester thereof, the polymer comprises at least 25 mol % of said monomer, more preferably at least 30, 35, 40, 45, 50, 55, 60, 65, 70, 75, or 80 mol % of said monomer. In an embodiment, said monomer contains one, two or three (preferably only one) carboxylic functionalities. In an embodiment, it has 6 carbon atoms or less, 5 carbon atoms or less, or 4 carbon atoms or less. Examples of suitable monomers include acrylic acid, methacrylic acid, malonic acid, methylmalonic acid, fumaric acid, maleic acid, itaconic acid, aconitic acid, mesaconic acid, citraconic acid, and salts or esters thereof. Preferably, said monomer is acrylic acid, methacrylic acid, or a salt or ester thereof.

In an embodiment, the first active agent is a homopolymer of a monomer having a carboxylic acid group or a salt or ester thereof. Polyacrylic acid and polyacrylate homopolymers are most preferred; these can have a variety of functions in automatic dishwashing, including as a builder or dispersing agent.

In another embodiment, the first active agent is a copolymer of the carboxylic monomer. It may be a block, alternating or random copolymer. Suitable copolymers include a copolymer of the carboxylic monomer with a sulphonated monomer. The sulphonated monomer may be, for example, an unsaturated hydrocarbon having a sulphonic acid group (or a salt thereof) but no other functional group. Examples include allylsulphonic acid, methallylsulphonic acid, vinylsulphonic acid, 2-methyl-2-propene-1-sulphonic acid, 3-sulphopropyl acrylate, 3-sulphopropylmethacrylate, and styrene sulphonic acid. The sulphonated monomer may be of the formula:

$$CH_2{=}CR^1{-}CR^2R^3{-}O{-}C_4H_7R^4{-}SO_3X$$

wherein $R^1$-$R^4$ are independently H or $C_{1-6}$ alkyl, and X is H or a suitable cation such as an alkali metal ion. Alternatively, the sulphonated monomer may comprise an acrylamido group or a salt thereof. Preferred such monomers include 2-acrylamido-2-methyl-1-propane sulphonic acid, 2-methacrylamido-2-methyl-1-propanesulphonic acid, 3-methacrylamido-2-hydroxy-propanesulphonic acid, sulphomethylacrylamide, sulphomethylmethacrylamide, or a salt thereof.

In an embodiment, the first active agent is a copolymer comprising (meth)acrylic acid monomer and a sulphonated monomer. Such copolymers can provide good anti-spotting/anti-filming performance. An especially preferred copolymer comprises (meth)acrylic acid and 2-acrylamido-2-methyl-1-propane sulphonic acid ("AMPS") monomers, preferably in a weight ratio of 50:50-95:5, preferably 60:40-90:10, preferably 70:30-85:15, preferably about 80:20.

In an embodiment, the polymer, which comprises a monomer having at least one carboxylic acid group or a salt or ester thereof, has an average molecular weight no more than 100,000 g/mol, more preferably no more than 50,000 g/mol, still more preferably no more than 20,000 g/mol.

In an embodiment, the polymer is a polyacrylic acid/polyacrylate homopolymer and has an average molecular weight of: at least 1000 g/mol, preferably at least 1500, 2000, 2500, 3000, 3500, or 4000 g/mol; and/or no more than 15,000 g/mol, preferably no more than 14,000, 13,000, 12,000, 11,000, 10,000, 9000, 8000, 7000, 6000, 5000, or 4500 g/mol.

In an embodiment, the polymer is a copolymer of acrylic acid or a salt thereof and has an average molecular weight of: at least 5000 g/mol, preferably at least 6000, 7000, 8000, 9000, 10,000, 11,000, or 12,000 g/mol; and/or no more than 20,000 g/mol, preferably no more than 19,000, 18,000, 17,000, 16,000, 15,000, 14,000, or 13,000 g/mol.

In an embodiment, the first active agent is a copolymer comprising the carboxylic monomer and a monomer comprising a quaternary ammonium group. Such copolymers can provide good anti-spotting/anti-filming performance. For example, the monomer comprising a quaternary ammonium group may be a monomer of the formula:

$$H_2C{=}CR^1{-}(CH_2)_n{-}N^+R^2R^3{-}(CH_2)_m{-}CR^4{=}CH_2X^-$$

wherein:

$R^1$ and $R^4$ are independently H or a linear or branched $C_1$-$C_6$ alkyl group, preferably both H;

$R^2$ and $R^3$ are independently an alkyl, hydroxyalkyl or aminoalkyl group wherein the alkyl group is a linear or branched $C_1$-$C_6$ chain, preferably both methyl;

n and m are independently 1, 2 or 3, preferably both 1; and X is a counterion.

Preferably, the copolymer comprises a diallyl dimethyl ammonium monomer. Preferably, it is a diallyl dimethyl ammonium/acrylamide/acrylic acid copolymer. Further suitable polymers are described in U.S. Pat. Nos. 6,569,261, 6,593,288, 6,703,358 and 6,767,410.

Preferably, where the first active agent is a polymer comprising a monomer having at least one imine group or a salt thereof, the polymer comprises at least 25 mol % of said monomer, more preferably at least 30, 35, 40, 45, or 50 mol % of said monomer. Preferably, the polymer is a polyalkyleneimine, an alkoxylated polyalkyleneimine, a copolymer of an alkylene imine, or a salt thereof. More preferably, the polymer is selected from the group consisting of polyethylene imine, ethoxylated polyalkyleneimine, ethoxylated polyethyleneimine, a copolymer of ethylene imine, and a salt thereof. Such polymers may provide a benefit of inhibition of glass corrosion.

Preferably, the molecular weight of the imine-based polymer is: at least 50, preferably at least 100, 150, 200, 300, 400, 500, 600, 700, or 800 g/mol; and/or no more than 200,000, preferably no more than 150,000, 100,000, 80,000, 50,000, 30,000, 10,000, 8000, 5000, 3000, 2000, 1500, or 1000 g/mol.

Suitable polymers include members of the Lupasol® series from BASF, such as Lupasol® FG.

Preferably, where the first active agent is a polymer comprising a monomer having at least one aspartic acid group or a salt or ester thereof, this polymer comprises at least 25 mol %, 40 mol %, or 50 mol %, of said monomer. Preferably, the polymer is poly(aspartic acid), in other words a homopolymer of aspartic acid. A suitable polymer is Baypure DS 100 from Lanxess.

Preferably, the first active agent is partially neutralized or fully neutralized. In other words, where the first active agent is a polymer comprising a carboxylic or aspartic monomer, at least a portion of the carboxylic acid groups are present in a salt form rather than as the free acid, preferably in the form of an alkali metal (e.g. sodium) salt. Where the first active agent is a polymer comprising an imine monomer, preferably at least a portion of the imine groups are present as a halide salt, rather than as the free base. In an embodiment, the first active agent is at least 10, 20, 30, 40, 50, 60, or 70 mol % neutralised and/or no more than 95, 90, 85, 80 or 75 mol % neutralized. The present inventors have found that where the first active agent is at least partially neutralized, it is more readily incorporated into the composition during manufacture and the risk of cross-linking is reduced. In an embodiment, it is a partially neutralized or fully neutralized acrylic acid homopolymer, preferably a partially neutralized acrylic acid homopolymer.

When the acidic monomers described herein are esterified, the ester group is preferably an alkyl ester, preferably $C_{1-6}$ alkyl ester, preferably methyl, ethyl, propyl or butyl ester, preferably methyl or ethyl ester.

In an embodiment, the first active agent is a solid at 25° C. Preferably, it is also a solid at 50° C., 100° C. or 150° C. This may reduce the chance that the first active agent migrates in or from the composition during storage or in use, and aids an even release profile as the composition dissolves or disperses. In another embodiment, the first active agent is a liquid at 25° C. but is incorporated into granules before being used to produce the inventive composition. Preferably, the first active agent is water-soluble.

Preferably, the composition comprises at least 6 wt % of the first active agent, preferably at least 7, 8, 9, 10, 11, 12, 13, 14, 15, 16, 17, 18, 19, or 20 wt %. Preferably, it comprises no more than 49.5 wt % of the first active agent, preferably no more than 49, 48, 47, 46, 45, 44, 43, 42, 41, or 40 wt %. The composition may include a mixture of first active agents as defined herein. In that case, the total amount of the first active agents is preferably from 10-50 wt %, such as from 20 to 40 wt %.

Second Active Agent

In an embodiment, the composition further comprises a second active agent selected from the group consisting of a surfactant, a bleach catalyst, and an enzyme. The second active agent is gradually released in use owing to the slow dissolution and/or dispersion of the composition. Preferably, the second active agent is present in an amount of 30 wt % or less, preferably 25, 20, 15, 10, or 5 wt % or less. More than one second active agent may be present, in which case the total amount of these is preferably within the same weight range.

When the second active agent is a surfactant, this may be selected from non-ionic, anionic, cationic and amphoteric surfactants, but is preferably a non-ionic surfactant. Non-ionic surfactants are generally preferred for automatic dishwashing as they are considered to be low foaming surfactants.

Suitable non-ionic surfactants are ethoxylated or propoxylated fatty alcohols, e.g. those with a $C_8$ to $C_{20}$ carbon chain. The degree of ethoxylation is described by the number of ethylene oxide units (EO), and the degree of propoxylation is described by the number of propylene oxide units (PO). Surfactants may also comprise butylene oxide units (BO) as a result of butoxylation of the fatty alcohol. Preferably, this will be a mix with PO and EO units. The surfactant chain can be terminated with a butyl moiety. The length of the fatty alcohol and the degree of ethoxylation/propoxylation determines if the surfactant structure has a melting point below room temperature or in other words if is a liquid or a solid at room temperature.

The compositions of the invention may comprise a liquid mixed alkoxylate fatty alcohol non-ionic surfactant comprising a greater number of moles of the lower alkoxylate group than of the higher alkoxylate group in the molecule. It is especially preferred that the mixed alkoxylate fatty alcohol nonionic surfactant comprises at least two of EO, PO or BO groups and especially a mixture of EO and PO groups, preferably EO and PO groups only. It is most preferred that the mole ratio of the lower alkoxylate group to the higher alkoxylate group is at least 1.1:1, more preferably at least 1.5:1, and most preferably at least 1.8:1, such as at least 2:1.

Alternative non-ionic surfactants are ethoxylated monohydroxy alkanols or alkylphenols which additionally comprise poly-oxyethylene-polyoxypropylene block copolymer units. The alcohol or alkylphenol portion of such surfactants preferably constitutes more than 30%, preferably more than 50%, more preferably more than 70% by weight of the overall molecular weight of the non-ionic surfactant.

Mixed alkoxylate fatty alcohol non-ionic surfactants used in the compositions of the invention may be prepared by the reaction of suitable monohydroxy alkanols or alkylphenols with 6 to 20 carbon atoms. Preferably the surfactants have at least 8 moles, particularly preferred at least 10 moles of alkylene oxide per mole of alcohol or alkylphenol.

Particularly preferred liquid mixed alkoxylate fatty alcohol non-ionic surfactants are those from a linear chain fatty alcohol with 12-18 carbon atoms, preferably 12 to 15 carbon atoms and at least 10 moles, particularly preferred at least 12 moles of alkylene oxide per mole of alcohol. When PO units are used they preferably constitute up to 25% by weight, preferably up to 20% by weight and still more preferably up to 15% by weight of the overall molecular weight of the non-ionic surfactant.

Suitable liquid mixed alkoxylate fatty alcohol non-ionic surfactants can be found in the class of reverse block copolymers of polyoxyethylene and poly-oxypropylene and block copolymers of polyoxyethylene and polyoxypropylene initiated with trimethylolpropane.

Suitable types can also be described by the formula:

$$R_1O[CH_2CH(CH_3)O]_x[CH_2CH_2O]_y[CH_2CH(OH)R_2]$$

where $R_1$ represents a linear or branched chain aliphatic hydrocarbon group with 4-18 carbon atoms or mixtures thereof, $R_2$ represents a linear or branched chain aliphatic hydrocarbon group with 2-26 carbon atoms or mixtures thereof, x is a value between 0.5 and 1.5 and y is a value of at least 15.

Another group of suitable liquid mixed alkoxylate fatty alcohol non-ionic surfactants can be found in the end-capped polyoxyalkylated non-ionic surfactants of formula:

$$R_1O[CH_2CH(R_3)O]_x[CH_2]_kCH(OH)[CH_2]_jOR_2$$

where $R_1$ and $R_2$ represent linear or branched chain, saturated or unsaturated, aliphatic or aromatic hydrocarbon groups with 1-30 carbon atoms, $R_3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5 with the proviso that the molecule contains more of the lower alkoxylate than of the higher alkoxylate. When the value of x is greater than 2, each $R_3$ in the formula above can be different. $R_1$ and $R_2$ are preferably linear or branched chain, saturated or unsaturated, aliphatic or aromatic hydrocarbon groups with 6-22 carbon atoms, where group with 8 to 18 carbon atoms are particularly preferred. For the group $R_3$=H, methyl or ethyl are particularly preferred. Particularly preferred values for x are comprised between 1 and 20, preferably between 6 and 15.

As described above, in the case where x is greater than 2, each $R_3$ in the formula can be different. For instance, when x=3, the group $R_3$ could be chosen to build ethylene oxide ($R_3$=H) or propylene oxide ($R_3$=methyl) units which can be used in every single order for instance (PO)(EO)(EO),(EO)(PO)(EO), (EO)(EO)(PO),(PO)(EO)(PO) and (PO)(PO)(EO). Only the mixed alkoxylates comprising more of the lower alkoxylate than of the higher alkoxylate are suitable as the claimed mixed alkoxylate fatty alcohol nonionic surfactant. The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R_1O[CH_2CH(R_3)O]_xCH_2CH(OH)CH_2OR_2$$

In a particularly preferred embodiment of the present invention the mixed alkoxylate fatty alcohol non-ionic surfactants have the general formula;

$$R_1\text{-}[EO]_n\text{—}[PO]_m\text{—}[BO]_p\text{-}Bu_q$$

wherein:

$R_1$ is an alkyl group of between $C_8$ and $C_{20}$,

EO is ethylene oxide;

PO is propylene oxide;

BO is butylene oxide;

Bu is butylene n and m are integers from 1 to 15;

p is an integer from 0 to 15; and q is 0 or 1.

Examples of especially preferred mixed alkoxylate fatty alcohol non-ionic surfactants can be found in the Plurafac®, Lutensol® and Pluronic® ranges from BASF and the Genapol® series from Clariant.

Further exemplary non-ionic surfactants include solid surfactants such as a non-ionic surfactant according to formula (I):

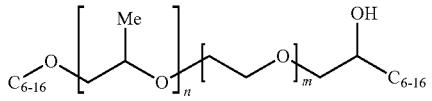

wherein n=0-5 and m=10-50;

or formula (II):

$$R^1O(AlkO)xM(OAlk)yOR^2$$

wherein $R^1$ and $R^2$ are independently branched or straight chain, saturated or unsaturated, and possibly hydroxylated, alkyl radicals with 4 to 22 carbon atoms;

wherein Alk is a branched or unbranched alkyl radical with 2-4 carbon atoms; wherein x and y are independently an integer between 1 and 70; and wherein M is an alkyl radical selected from the group $CH_2$, $CHR^3$, $CR^3R^4$, $CH_2CHR^3$, $CHR^3CHR^4$, wherein $R^3$ and $R^4$ are independently a branched or straight chain saturated or unsaturated, alkyl radicals with 1 to 18 carbon atoms.

The use of a mixture of any of the aforementioned non-ionic surfactants is suitable in compositions of the present invention, e.g. mixtures of alkoxylated alcohols and hydroxy group containing alkoxylated alcohols.

Preferably, the surfactant is a solid at 25° C. Solid surfactants are more easily processed in the method of the invention and are less likely to migrate in the composition during storage.

Preferably, when non-ionic surfactant is present in the composition, it is present in a total amount of at least 5 wt %, preferably at least 6, 7, 8, 9, 10, 11, 12, 13, 14, or 15 wt %; and/or in a total amount of 30 wt % or less, preferably 29, 28, 27, 26, 25, 24, 23, 22, 21, or 20 wt % or less.

Preferably, the total amount of anionic surfactant in the composition is less than 10 wt %, preferably less than 8 wt %, less than 5 wt %, less than 4 wt %, less than 3 wt %, less than 2 wt %, less than 1 wt %, less than 0.5 wt %, less than 0.1 wt %, or less than 0.01 wt %. Preferably, the composition contains no anionic surfactant.

In an embodiment, the composition contains less than 10 wt % in total of cationic surfactant and/or amphoteric surfactant, preferably less than 8 wt %, less than 5 wt %, less than 4 wt %, less than 3 wt %, less than 2 wt %, less than 1 wt %, less than 0.5 wt %, less than 0.1 wt %, or less than 0.01 wt %, of either or both of these ingredients. Preferably, the composition contains no cationic surfactant and/or amphoteric surfactant.

When the second active agent is a bleach catalyst, this may be any suitable catalyst known in the art, for example a manganese bleach catalyst such as manganese oxalate or Mn(TACN). The bleach catalyst is preferably present in an amount of 5 wt % or less, preferably 4, 3, 2, or 1 wt % or less.

When the second active agent is an enzyme, this is preferably selected from the group consisting of a protease, amylase, cellulase, pectinase, mannanase, lipase, glucose oxidase, peroxidase, and estertransferase. A mixture of enzymes may be used, preferably at least one protease and at least one amylase. The enzyme may be liquid or solid, although preferred enzymes are solid granulated enzymes or combinations of granules of different enzymes. The enzymes are intended to perform a cleaning function.

When one or more enzymes are present in the composition, they are preferably present in a total amount of 5 wt % or less (by active enzyme content), preferably 4, 3, 2, 1, 0.5, 0.1, 0.05, or 0.01 wt % or less (by active enzyme content).

Preferably, the composition is a dishwasher additive composition. In other words, the composition is preferably distinct from the main cleaning composition and is added to the dishwasher separately. Preferably, the composition is a rinse aid composition. In an embodiment, the composition of the present invention is particularly effective at reducing spotting and/or improving shine.

In an embodiment, the composition is substantially free, preferably completely free, of one or more of the following active agents: enzymes, builder (aside from the first active agent, which may have builder function), bleach, bleach activator, bleach catalyst, corrosion inhibitor (aside from the first active agent, which may have corrosion inhibitor function). Such ingredients may not need to be included in the composition of the invention, when it is used together with a separate main wash detergent containing such ingredients that is supplied to each dishwasher wash program.

Colourant & Perfume

Because of the slow-dissolving nature of the composition, it is able to act as an indicator which, when fully dissolved, alerts the user as to when a particular composition needs to be added and/or a particular maintenance task needs to be performed. For example, the complete dissolution of the composition may alert the user as to when a machine cleaner needs to be added. The number of wash programs between introducing the composition into the machine and full dissolution can be tuned by selecting an appropriate mass of the composition, dissolution rate (e.g. by selecting an appropriate degree of hydrolysis of the vinyl acetate-vinyl alcohol copolymer) and the like.

Preferably, the composition of the invention is coloured so that complete dissolution can be more easily seen. Ingredients discussed above, such as bleach catalysts, may already impart a colour to the composition. In an embodiment, the composition further comprises at least one dye and/or pigment, more preferably in a total amount of: at least 0.01 wt %, preferably at least 0.05 or 0.1 wt %; and/or no more than 1 wt %, preferably no more than 0.5 wt %.

The composition may also include a perfume to provide it with a pleasant fragrance. In an embodiment, it is free of perfume, since perfume released during a wash program and deposited on the dishes may be perceived as disagreeable by some consumers.

Processing Additives

It may be possible to process the composition of the invention without requiring the inclusion of any lubricant, filler or binder. Lubricants include fatty acid amides and stearate salts such as magnesium stearate. Fillers include talc and inorganic carbonates such as calcium carbonate. Magnesium and calcium salts are particularly undesirable in automatic dishwashing as they tend to be insoluble and precipitate during the wash. Preferably, the composition comprises less than 10 wt %, preferably less than 9, 8, 7, 6, 5, 4, 3, 2 or 1 wt %, of calcium carbonate or inorganic carbonate. It is also not necessary to add any organic solvent.

Preferably, the composition consists essentially of, or consists of, the compulsory ingredients (namely the at least one vinyl acetate-vinyl alcohol copolymer, the at least one polyhydric alcohol, and the at least one first active agent) and optionally one or more of the polyvinyl acetate, the second active agent, the colourant, or the perfume. In other words, these specified optional ingredients may or may not be present, but there are no (or essentially no) other ingredients present apart from ones from the compulsory class.

Solubility

Preferably, the composition gradually dissolves and/or disperses over a plurality of wash programs in a machine dishwasher. This dissolution or dispersion can be effected by contact with a conventional spray or jet of water in the machine dishwasher, or with water circulating in the machine tank (depending on the location of the composition). The term "wash program" as used herein refers to the entire cleaning cycle of the dishwasher, that is, including any initial pre-rinse, the main wash cycle, and all subsequent rinsing and drying stages. Thus, the composition is able to survive for multiple entire cleaning operations, rather than merely for, e.g. the main wash cycle and rinse cycle of a single wash program. Preferably, the composition gradually dissolves and/or disperses over at least 3 wash programs in a machine dishwasher, more preferably at least 4, 5, 6, 7, 8, 9, 10, 11, 12, 13, 14, 15, 16, 17, 18, 19, or 20. Preferably, the composition gradually dissolves and/or disperses over at most 35 wash programs in a machine dishwasher, preferably at most 34, 33, 32, 31, or 30. It is to be understood that the composition fully dissolves and/or disperses by the end of its final wash program. As such, there is no composition residue left behind after the lifetime of the product that the user must then remove and dispose of.

In an embodiment, the composition dissolves and/or disperses over the above-mentioned number of wash programs as measured according to the following method: place 15 g of sample in a tea sieve, and subject the loaded tea sieve to the Eco 50° C.+Vario Speed (no 3-in-1 function) program at a water hardness of 21° GH in a Bosch SGS058M02EU/36 dishwashing machine. The program is repeated until the sample is fully dissolved and/or dispersed.

Product Format

It is desired that the composition of the invention is in the form of a solid or gel, preferably a firm gel. By "firm" it is meant that the gel is free-standing at 25° C., retaining its shape without taking the shape of a container it is placed into. When in solid form, this is preferably a solid block rather than in the form of a powder or granules, but preferably not a tablet (i.e. compressed powder/granular) form. In other words, it is preferably a continuous phase solid, rather than a simple mixture of different particles of the individual ingredients (whether or not compressed into a tablet form). It may be, for example, in the form of a filament or a disc. In an embodiment, it is a resin blend. Preferably, the composition is in the form of an extrudate.

Accordingly, the composition need not be placed into the detergent dispenser, but instead can be placed inside the dishwasher as its own dosage form, without requiring any external packaging or supply means. For example, the composition may take the form of a body that is placed inside (or hung from) a rack in a dishwasher, slowly eroding over a plurality of wash programs due to direct contact with water. Alternatively it may be stuck to an internal wall of the dishwasher or provided loose at the bottom of the tank.

On the other hand, in the second aspect of the invention, the composition is provided inside a package, particularly a water insoluble package such as an insoluble plastic container. This may, for example, have holes or slits through which water can pass to dissolve the inventive composition and carry it back out to the dishwasher tank.

Pouch/capsule formats are known, in which an automatic dishwashing composition is enclosed within a container that is made of a highly water soluble polyvinyl alcohol (designed to dissolve at an early stage during a single wash program). It is to be understood that, in the present invention, the compulsory vinyl acetate-vinyl alcohol copolymer ingredient is in the form of a mixture with the other ingredients of the composition and not used as such an enclosing material. Nevertheless, if desired, the composition may additionally be provided inside the conventional type of water soluble pouch. A consumer could throw such a pouch into the bottom of the tank; being slow-dissolving, the inventive composition does not need to be protected from being washed away in the pre-rinse cycle by being placed in the main wash dispenser.

Since it is desired to have the flexibility to dose the inventive composition only once in a plurality of wash programs, whereas a main wash detergent should be dosed in each wash program, it is preferred that the inventive composition is in a separate product from any main wash detergent composition. For example, the inventive composition and a main wash detergent composition are not provided in separate compartments of a multi-compartment pouch.

In the context of the second aspect of the invention, the packaging material is not considered part of the composition and so the weight of the packaging material is not included when calculating wt % amounts of ingredients in the composition.

In an embodiment, the total weight of the composition (whether or not packaged) is: at least 5 g, preferably at least 10 or at least 15 g; and/or no more than 50 g, preferably no more than 40, 30, or 20 g.

Manufacturing Method

It is desired that the ingredients of the composition are blended together as homogeneously as possible. However, at least the vinyl acetate-vinyl alcohol copolymer used herein is generally a solid ingredient. Thus it is necessary to heat the composition ingredients to soften or melt the solid polymer(s) and blend them together. The preferred method of manufacture is by extrusion.

Suitable conditions for extrusion are well known in the art. For example, the blend can be extruded via a funnel using a Collin® twin screw extruder in a closed system. Preferably, the blend is extruded at a temperature of: at least 150° C., preferably at least 160, 170, 180, 190, 200, or 210° C.; and/or no more than 250° C., preferably no more than 240, 230, or 225° C.

After extrusion, the extrudate may be subjected to further processing to form the composition into the desired shape, such as injection-moulding, blow-moulding, or thermoforming. These techniques are well known in the art.

The first active agent polymers specified herein are potentially crosslinkable polymers. Under the elevated temperature conditions necessary to blend the first active agent with the vinyl acetate-vinyl alcohol copolymer and other components of the composition during manufacture, the skilled person might expect these polymeric ingredients to crosslink with themselves and/or with each other (noting that the vinyl acetate-vinyl alcohol copolymer is more reactive than copolymers having a lower degree of hydrolysis). This would prevent or inhibit their release during use in the dishwasher. Accordingly, it is surprising that these active agents are slowly released as the composition disperses and/or dissolves and are thereby able to perform their intended function.

Machine Dishwashing Method

In the fourth aspect of the invention, the inventive composition is placed inside a machine dishwasher which is run for a plurality of wash programs. The first active agent is released into the wash water over the plurality of wash programs. Preferably, the dishwasher is a domestic dishwasher. In an embodiment, it is a single tank dishwasher and/or has a detergent dispenser in the door of the machine. In an embodiment, each of the plurality of wash programs lasts at least 15 minutes, preferably at least 20, 25, 30, 35, 40, 45, 50, 55, 60, 65, 70, 75, 80, 85, 90, 95, 100, 120, 150, or 180 minutes; but preferably no more than 240 minutes, preferably no more than 200 minutes. In an embodiment, the maximum temperature reached during the plurality of wash programs is 75, 70, 65, 60, 55, 50, 45, or 40° C.

Preferably, no more than 25 wt % of the composition is dissolved and/or dispersed in the wash water during the first wash program, more preferably no more than 20, 15, 10, 9, 8, 7, 6, 5, or 4 wt %. Preferably, the composition is dissolved (at least approximately) evenly over the plurality of wash programs, i.e. a substantially similar dose of the active agent(s) is delivered into the wash water in each of the plurality of wash programs. Preferably, the composition is not replenished in the dishwasher until it is fully dissolved and/or dispersed at the end of the plurality of wash programs.

In an embodiment, the user introduces the composition into a part of the machine other than the detergent dispenser. Preferably, a dishwasher detergent is added separately to the machine, optionally to the detergent dispenser. If the inventive composition has rinse aid function, the user need not add additional rinse aid liquid to the rinse aid dispenser of the machine. It is understood that whilst the detergent dispenser only opens during the wash cycle of the program, and the rinse aid dispenser only doses rinse aid during the rinse cycle, once a composition of the invention has been dosed into the tank it will remain there for the plurality of wash programs, and so will be releasing its active agent(s) gradually during both the subsequent wash and rinse cycles.

In an embodiment, after the plurality of wash programs has completed, a maintenance task is performed, for example a further wash program is run using a dishwasher machine cleaner composition. Preferably, this is an acidic composition to remove limescale. The program may be run whilst the machine is empty of wares.

The present invention will now be described in relation to the following non-limiting examples.

Example 1

Compositions comprising a first active agent in accordance with the present invention were prepared in the form of extruded fibres by extrusion at 220° C. on a 15 g scale via a funnel using a Collin® twin screw extruder in a closed system. The homogeneity of the resulting product was noted. A sample was then weighed and placed in a metal basket immersed in water at 50° C. with gentle stirring. At the end of a period of 8 hours, the sample was reweighed and the sample recovery calculated.

The compositions prepared were as follows (amounts in wt %):

| Composition | 1 | 2 | 3 | 4 | 5 |
|---|---|---|---|---|---|
| Mowiol 6-98[1] | 35 | 55 | 55 | 55 | 55 |
| PVOAc | 15 | 15 | 15 | 15 | 15 |
| Glycerol | 10 | 10 | 10 | 10 | 10 |
| Polycarbolane 7000 FN[2] | 40 | 20 | — | — | — |
| Sokalan PA 25[3] | — | — | 20 | — | — |
| Acusol 588[4] | — | — | — | — | 20 |
| Mirapol Surf S 480PF[5] | — | — | — | 20 | — |
| Homogeneous product? | Yes | Yes | Yes | Yes | Yes |
| % recovery | 56 | 73 | nd | 84 | nd |

nd = not determined

[1]vinyl acetate-vinyl alcohol copolymer, degree of hydrolysis 98.0-98.8 mol % (Kuraray)

[2]acrylic acid homopolymer, sodium salt (fully neutralised) having an average molecular weight of 7000 (Inprotec AG)

[3]acrylic acid homopolymer, sodium salt (partially neutralised) having an average molecular weight of 4000 (BASF)

[4]acrylic acid/2-acrylamido-2-methylpropane sulfonic acid (AMPS) copolymer (Dow)

[5]acrylic-based copolymer (Rhodia)

As can be seen from the table, acrylic-based polymers (including copolymers) can be introduced in large amounts without compromising the homogeneity of the composition. All the tested compositions dissolved appropriately slowly under the experimental conditions; dissolution was slower with increased content of high hydrolysis vinyl acetate-vinyl alcohol copolymer, whilst the tested composition comprising acrylic copolymer dissolved slower than the one comprising acrylic homopolymer.

Example 2

Five compositions were prepared in accordance with the method of Example 1, and their rinse performance measured when used in combination with a 18 g phosphate-free dishwashing tablet based on citrate. This was compared with the performance achieved by using the tablet alone (control).

Specifically, 18.5 g of the composition was added into the dispenser of a Bosch SGS058M02EU/36 dishwashing machine together with the tablet. The dishwasher was loaded with longdrink glasses, whiskey glasses, Ventura knives, porcelain plates, melamine plastic plates, and PP bowls. The machine was run five times using the Eco 50° C.+Vario Speed (no 3-in-1 function) program (without replenishing the composition each time). The water hardness was 21° GH.

Spotting/filming on the wares at the end of the 5 wash programs was assessed by viewing them in a lit black box. The average results are given in the following table and are expressed on a scale of 1 to 10 (1 being worst with extreme spotting and filming and 10 being best with no visible spotting and filming).

As can be seen, all the tested compositions improved the spotting score compared to the control, and gave at least a small improvement in the filming score. This shows that the first active agent is not locked inside the composition (e.g. by crosslinking) but instead can be released and perform its function over time as the rest of the composition dissolves.

| Composition | Control | 6 | 7 | 1 | 8 |
|---|---|---|---|---|---|
| Mowiol 6-98 | — | 35 | 55 | 35 | 35 |
| PVOAc | — | 15 | 15 | 15 | 15 |
| Glycerol | — | 10 | 10 | 10 | 10 |
| Acusol 588 | — | 40 | — | — | — |
| Mirapol Surf S | — | — | 20 | — | — |

-continued

| Composition | Control | 6 | 7 | 1 | 8 |
|---|---|---|---|---|---|
| Polycarbolane 7000 | — | — | — | 40 | — |
| Sokalan PA 25 | — | — | — | — | 40 |
| Average spotting | 1.40 | 1.83 | 2.15 | 3.95 | 3.28 |
| Average filming | X | X# | X## | 2.23* | 6.23 |

*iridescence filming on the cutlery and inside the dishwasher

X no evaluation possible because of the bad filming; test stopped

X# 5.0 on PP bowls; no evaluation possible on other items

X## 5.8 on PP bowls, 7.0 on longdrink glasses; no evaluation possible on other items

Example 3

A composition according to the invention, which comprised a blue dye, was prepared using the method of Example 1 and pressed into an approximately 7 cm by 7 cm square sheet and placed into a dishwasher rack. The dishwasher was run for multiple wash programs, after which dissolution of the coloured sheet was clearly evident, and as well as the improved rinse performance this additionally acted as a signal that it was time to use a machine cleaner composition to clean the machine.

The foregoing detailed description has been provided by way of explanation and illustration, and is not intended to limit the scope of the appended claims. Many variations in the presently preferred embodiments illustrated herein will be apparent to one of ordinary skill in the art.

The invention claimed is:

1. A machine dishwashing detergent or additive composition comprising:

from 25 to 80 wt % of a vinyl acetate-vinyl alcohol copolymer, wherein the vinyl acetate-vinyl alcohol copolymer comprises at least 85 mol % vinyl alcohol units, has an average molecular weight of 30,000 to 90,000 g/mol, and has a degree of hydrolysis of 95 to 99 mol %;

from 1 to 25 wt % of a polyhydric alcohol; and from 5 to 50 wt % of a first active agent comprising a polymer comprising a monomer selected from the group consisting of a monomer having at least one carboxylic acid group or a salt or ester thereof, having at least one imine group or a salt thereof, and having at least one aspartic acid group or a salt or ester thereof, wherein the composition gradually dissolves and/or disperses over a plurality of wash programs in the machine dishwasher, wherein the vinyl acetate-vinyl alcohol copolymer is in the form of a mixture with the other ingredients of the composition and is not used as an enclosing material.

2. The composition according to claim 1, wherein the first active agent comprises a polymer comprising at least 25 mol % of a monomer having at least one carboxylic acid group or a salt or ester thereof.

3. The composition according to claim 1, wherein the polyhydric alcohol is glycerol.

4. The composition according to claim 1 further comprising a second active agent selected from the group consisting of a surfactant, a bleach catalyst, an enzyme, a dye and a pigment.

5. The composition according to claim 1 further comprising from 1 to 30 wt % of a polyvinyl acetate.

6. A machine dishwashing detergent or additive composition consisting essentially of:

from 25 to 80 wt % of a vinyl acetate-vinyl alcohol copolymer wherein the vinyl acetate-vinyl alcohol copolymer comprises at least 85 mol % vinyl alcohol units, has an average molecular weight of 30,000 to 90,000 g/mol, and has a degree of hydrolysis of 95 to 99 mol %;

from 1 to 25 wt % of a polyhydric alcohol;

from 5 to 50 wt % of a first active agent comprising a polymer comprising a monomer selected from the group consisting of a monomer having at least one carboxylic acid group or a salt or ester thereof, having at least one imine group or a salt thereof, and having at least one aspartic acid group or a salt or ester thereof;

optionally a polyvinyl acetate; and optionally a colorant, wherein the composition gradually dissolves and/or disperses over a plurality of wash programs in the machine dishwasher, wherein the vinyl acetate-vinyl alcohol copolymer is in the form of a mixture with the other ingredients of the composition and is not used as an enclosing material.

7. The composition according to claim 1, which is in the form of an extrudate.

8. A package containing the composition according to claim 1.

9. A method of preparing a composition according to claim 1 comprising extruding the vinyl acetate-vinyl alcohol copolymer, the polyhydric alcohol and the first active agent.

10. A method of machine dishwashing comprising using the composition according to claim 1 comprising releasing the first active agent into wash water over the course of a plurality of dishwashing programs.

11. The method according to claim 10, wherein no more than 25 wt % of the composition is dissolved and/or dispersed in the wash water during a first dishwashing program of the dishwashing programs.

12. The method according to claim 11 further comprising running a dishwashing cycle using a machine cleaner composition once complete dissolution and/or dispersion of the composition has occurred.

13. The composition according to claim 1, wherein the first active agent comprises a polymer comprising at least 25 mol % of a homopolymer or copolymer of (meth)acrylic acid or a salt thereof.

14. An alert method for a dishwashing machine comprising:

using an amount of the composition according to claim 1 in a plurality of dishwashing programs;

alerting once the amount of the composition has fully dissolved or dispersed.

15. The alert method of claim 14, wherein alerting occurs upon completion a dishwashing program where the amount of the composition has fully dissolved or dispersed.

16. The alert method of claim 14, wherein alerting comprises signalling to clean the dishwasher with a machine cleaner composition.

* * * * *